US010738373B1

(12) United States Patent
Benafan et al.

(10) Patent No.: US 10,738,373 B1
(45) Date of Patent: Aug. 11, 2020

(54) APPARATUS AND METHOD FOR USING SHAPE MEMORY ALLOYS TO FORM SHAPES

(71) Applicant: United States of Americas as represented by the Administrator of NASA, Washington, DC (US)

(72) Inventors: Othmane Benafan, Middleburg Heights, OH (US); Eunice E. Arvizu, Middleburg Heights, OH (US)

(73) Assignee: United States of America as Represented by the Administrator of National Aeronautics and Space Administration, Washington, DC (US)

( * ) Notice: Subject to any disclaimer, the term of this patent is extended or adjusted under 35 U.S.C. 154(b) by 211 days.

(21) Appl. No.: 15/715,687

(22) Filed: Sep. 26, 2017

Related U.S. Application Data

(60) Provisional application No. 62/400,149, filed on Sep. 27, 2016.

(51) Int. Cl.
*C22F 1/00* (2006.01)
*C22F 1/10* (2006.01)

(52) U.S. Cl.
CPC ..... *C22F 1/006* (2013.01); *C22F 1/10* (2013.01)

(58) Field of Classification Search
CPC .. C22F 1/006; C22F 1/00; B21F 45/00; B21F 1/002; B21F 43/00; B21F 33/002; B21F 33/007; Y10T 29/49588
USPC ..... 148/563
See application file for complete search history.

(56) References Cited

U.S. PATENT DOCUMENTS 5,878,788 A * 3/1999 Gurry ..... B21F 1/002 140/71 R
7,866,154 B2 * 1/2011 Hamaguchi ..... B21C 47/003 29/447
2004/0025984 A1 * 2/2004 Holemans ..... A44C 5/0092 148/563

OTHER PUBLICATIONS

Sun, L., Huang, W. M., Ding, Z., Zhao, Y., Wang, C. C., Purnawali, H., & Tang, C. (2012). Stimulus-responsive shape memory materials: a review. Materials & Design, 33, 577-640 (Year: 2012).*
The Conteti Company, Pepetools Jump Ring Maker, (Mar. 16, 2015 from Wayback machine), p. 1. (Year: 2015).*
Sun, L., Huang, W. M., Ding, Z., Zhao, Y., Wang, C. C., Purnawali, H., & Tang, C. Stimulus-responsive shape memory materials: A review. Materials & Design, 33, 577-640 (2012). (Year: 2012).*

* cited by examiner

*Primary Examiner* — Anthony J Zimmer
*Assistant Examiner* — Ricardo D Morales
(74) *Attorney, Agent, or Firm* — Robert H. Earp, III; Helen M. Galus

(57) ABSTRACT

An apparatus and method for creating shapes (e.g., letters, numbers, characters, symbols, or a combination thereof) using shape memory alloy (SMAs) component. The SMA components shaped into formed shapes that can then be distorted to obscure the original formed shaped. The original formed shape can be restored upon exposure to a heat source, magnetic field, or upon load removal.

6 Claims, 7 Drawing Sheets

APPARATUS AND METHOD FOR USING SHAPE MEMORY ALLOYS TO FORM SHAPES

CROSS-REFERENCE TO RELATED APPLICATIONS

This application claims the benefit of U.S. Provisional Patent Application Ser. No. 62/400,149 entitled "Shape Memory Alloy (SMA-Art) Shapes" filed on Sep. 27, 2016, the entirety of which is incorporated by reference herein.

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 U.S.C. 2457).

TECHNICAL FIELD

The general field of this innovation is an apparatus and method for forming shapes (letters, numbers, characters, symbols, or three-dimensional art) using shape memory alloys.

SUMMARY

The following presents a simplified summary of the innovation in order to provide a basic understanding of some aspects of the innovation. This summary is not an extensive overview of the innovation. It is not intended to identify key/critical elements of the innovation or to delineate the scope of the innovation. Its sole purpose is to present some concepts of the innovation in a simplified form as a prelude to the more detailed description that is presented later.

The innovation disclosed and claimed herein, in aspects thereof, comprises an apparatus and method for creating formed shapes using shape memory alloy (SMA) components in a preformed outline.

In one embodiment, the SMA component may be used to form various shapes, including letters, numbers, characters, symbols, three-dimensional art or a combination thereof. According to the innovation, the formed shapes can then be distorted to obscure the original formed shaped. The original formed shape can be restored upon exposure to a heat source, magnetic field, or upon load removal.

To the accomplishment of the foregoing and related ends, certain illustrative aspects of the innovation are described herein in connection with the following description and the annexed drawings. These aspects are indicative, however, of but a few of the various ways in which the principles of the innovation can be employed and the subject innovation is intended to include all such aspects and their equivalents. Other advantages and novel features of the innovation will become apparent from the following detailed description of the innovation when considered in conjunction with the drawings.

DETAILED DESCRIPTION

Figure 1:
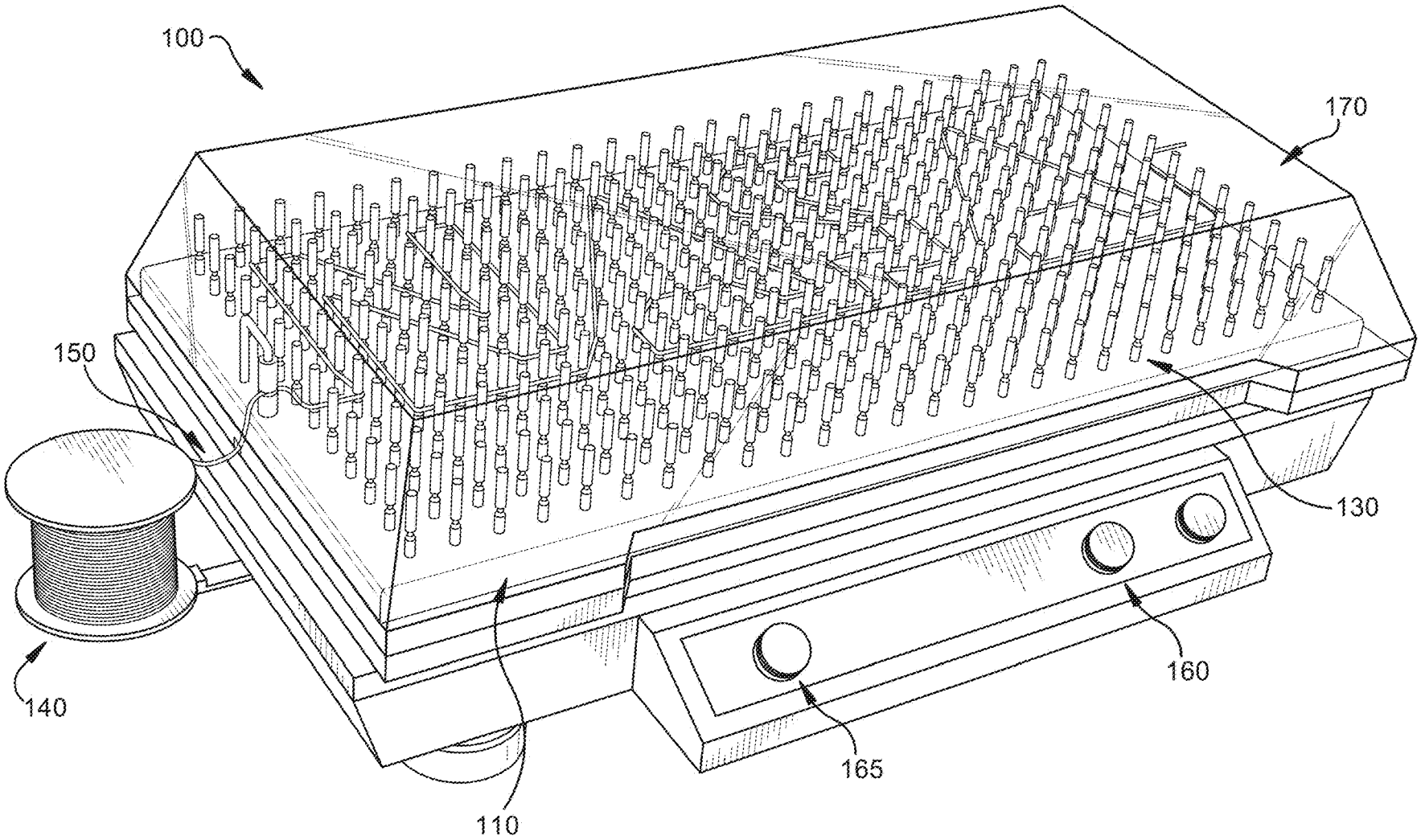
FIG. 1 is an illustration of an apparatus according to an example of the innovation.

The innovation is now described with reference to the drawings, wherein like reference numerals are used to refer to like elements throughout. In the following description, for purposes of explanation, numerous specific details are set forth in order to provide a thorough understanding of the subject innovation. It may be evident, however, that the innovation can be practiced without these specific details. In other instances, well-known structures and devices are shown in block diagram form in order to facilitate describing the innovation.

Shape memory alloys have the unique ability to recover from large deformations in response to thermal, mechanical and/or magnetic stimuli. This behavior occurs by virtue of a crystallographically reversible martensitic phase transformation between a high symmetry parent austentite phase a lower symmetry martensite phase. Generally, when the material is deformed in the martensitic condition, the induced deformation can be recovered by applying a stimulus above a certain magnitude (e.g., above a certain temperature, load, or magnetic field), but, as long as the critical transition point is not reached, it will retain the deformed condition indefinitely until actuated (e.g., the certain magnitude is attained).

According to an aspect, the innovation includes an SMA component that may be in the form of a wire, a cable, a tube, a ribbon, or any other structure amenable to manipulation into a specified formed shape and heat treated. In one embodiment, the SMA component may be formed around supports (e.g., mandrels, pegs, pins, modular pedestals) of a predefined outline. (See FIG. 3) The formed shape may then be distorted into a form that is not the specified formed shape. The original formed shape can be recovered once the SMA shape is exposed to heat, a magnetic field, or upon load removal.

In one embodiment, the apparatus may include SMA component in spools made of alloys that exhibit the shape memory effect (e.g., temperature-induced activation). In one embodiment, the SMA component also exhibits superelasticity (e.g., stress-induced activation). In another embodiment, the SMA component exhibits some amount of magnetism (e.g., magnetically-induced activation. In one embodiment, the SMA component exhibits shape memory effect, superelasticity, and magnetism.

The SMA component may be routed and positioned to form a predetermined outline. In one embodiment, the SMA component may be routed and positioned around an outline made by choosing the appropriate supports (e.g., pins or pedestals) having the desired form. In an embodiment, once the predetermined outline is formed, the outline can be locked and connected to a heating circuit (e.g., joule heating, hot plate, heat gun). The circuit may include control dials and indicators to ensure safe and accurate operation of the apparatus. The final product will be a desired shape that can be deformed and recovered once activated. (See FIGS. 5A and 5B.)

In one embodiment, the apparatus may include a control panel that includes control logic to measure and control the temperature or current, timers, and lighting to indicate the stages of the process. The control panel may include sensors and monitors, including temperature sensors. It may also include control logic to control the dispensing of the SMA component.

The SMA components may be used to construct customizable specified formed shapes (e.g., letters, symbols, words, characters, numbers, etc.) from a material feedstock (e.g., wire, tubes, ribbon, etc.).

In one embodiment, the apparatus includes the capability to choose the desired shape by selecting one of at least two predetermined outlines (e.g., wherein the apparatus includes a variety of outlines that can be selectively utilized) or the ability to create a predetermined outline by arranging the supports.

According to an aspect, the innovation may include a kit comprising a predetermined outline, the SMA components, a means for heating the SMA component, a temperature monitor, and an enclosure to house electronics and hardware. In one embodiment, instead of the predetermined outline, the kit may include the components for creating a predetermined outline such as supports for the SMA component and a means for securing the supports (e.g., pegs, pins, or pedestals that can be secured with a platform). In one embodiment, the kit may include at least two predetermined outlines. In one embodiment, the kit may include shape setting parameters for common SMA materials that include temperatures, times and cooling environments.

According to an aspect of the innovation, shape memory alloys may be utilized to create a specified formed shape by deforming the SMA component into a form, constraining the SMA component in all dimensions, heating the SMA component to a certain temperature, holding the SMA component isothermally for a period of time, and cooling the SMA component to room temperature under the same dimensional constraint. This process is known as shape setting.

For conventional NiTi-based alloys with higher titanium content, shape setting may be performed at 450° C. for 5-10 minutes follow by water quenching. For alloys with higher nickel content, temperatures between 500 and 550° C. may be used for 2-5 minutes. Shape setting is material specific and should be varied accordingly. According to an aspect, the innovation includes an apparatus and a method for varying multiple shape setting cases and determining the proper temperature and time.

According to an aspect, the innovation includes an apparatus and a method for shaping an SMA component into forms of various shapes and sizes. The support structure may be secured to the platform by most any means or it may be integrally formed with the platform. In one embodiment, the apparatus includes a support structure (e.g., a mandrel) secured to a platform. In one embodiment, the support structure is removably secured to the platform. In one embodiment, the support structure is permanently secured to the platform (e.g., via a fixative, soldered, or molded as one piece.)

In one embodiment, the apparatus includes a platform. The platform may be any shape or size. The platform may be in the form of one or more blocks.

The platform accommodates a plurality of support structures such as mandrels, pegs, pins, pedestals, spindles, or the like. In one embodiment, the platform has one or more arrays of holes for receiving the plurality of support structures. The support structures may be positioned in any manner to accommodate various uses.

In one embodiment, the support structures may be removably secured to the platform such that the support structures may be placed in any desired configuration. In one embodiment, the support structures may be of various sizes (e.g., various heights, widths, diameters, etc.) or shapes. In one embodiment, the support structure may have a preset predetermined configuration (e.g., the support structures may be permanently secured to the platform).

The apparatus may include more than one predetermined configuration of support structures. In one example of the innovation, the apparatus may include two or more platforms, each with a different configuration of support structures. Different configurations can be accomplished most any way, including by varying the placement of holes in the array of holes for receiving the plurality of support structures or by varying the configuration of support structures that are permanently secured to the platform.

In one embodiment, the apparatus includes a chamber. The chamber may be completely or partially enclosed. The chamber may also be completely open to the environment. In one embodiment, the chamber is defined by the shape of the platform. In another embodiment, the apparatus may include a lid or cover (including a partial lid or partial cover). In this embodiment, the chamber is formed between the lid or cover and the platform.

The chamber may be heated by a heating element according to an aspect of the innovation. The heating element may be controlled by a controller. The heating element may be used to heat the SMA component after forming the desired formed shape. The desired formed shape can then be distorted to an unrecognizable form. The desired formed shape can then be recovered by heating the heating element of the apparatus.

It is also understood that the apparatus includes the necessary hardware and/or software to control and monitor various aspects of the innovation. For example, the electronics for controlling and monitoring the heating element may be housed within the apparatus. Similarly, the hardware and/or software needed to operate a magnetic force or to apply a physical load may be housed within the apparatus.

Referring to FIG. 1, the apparatus 100 according to an example of the innovation may include a platform 110 that includes an array of holes for receiving a support structure 130. The apparatus may include a heating element (not shown) that may be controlled by knobs 165 located on a control panel 160 of the apparatus 100. The apparatus may also include a lid 170 that fits over the platform 110, including the array of holes. The apparatus may include a holding device/dispenser 140 to hold a shape memory alloy (SMA) component 150 (e.g., a wire made from SMA).

Figure 2:
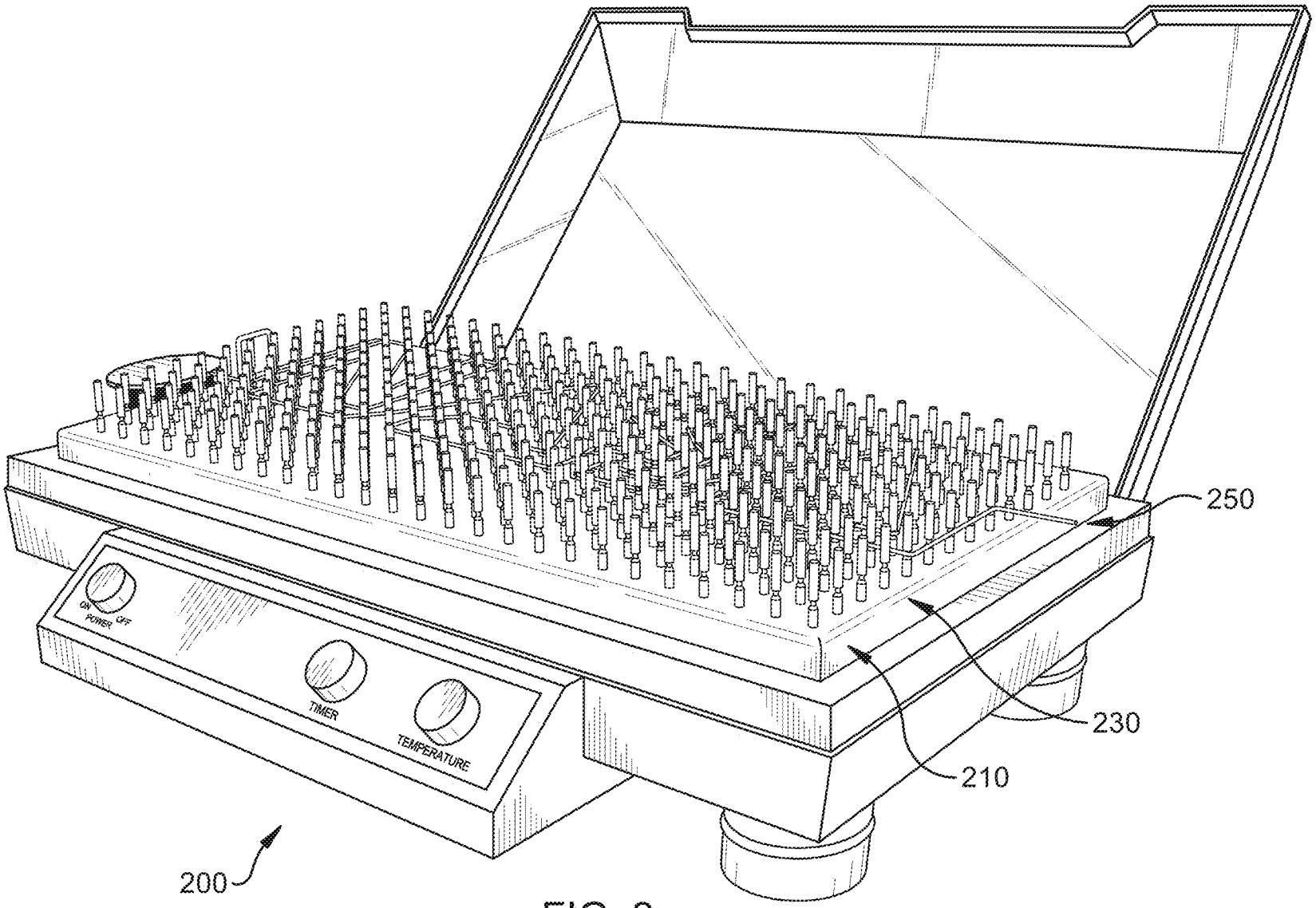
FIG. 2 is a rendering of an apparatus according to an example of the innovation.

Referring to FIG. 2, the apparatus 200 according to an example of the innovation may be used to create a formed shape from the SMA component 250 by bending or otherwise shaping the SMA component 250 around the support structure that is secured to the platform 210

Figure 3:
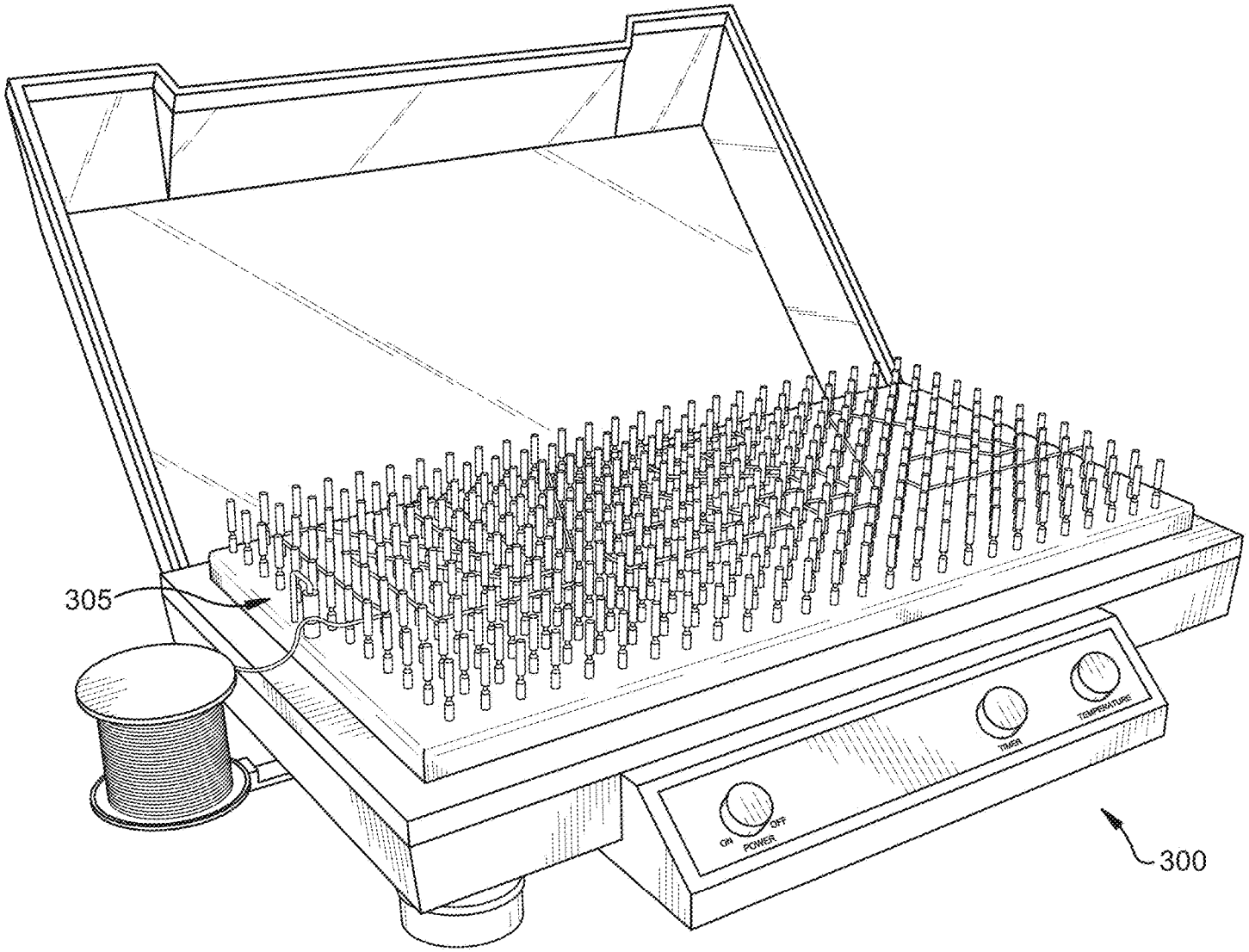
FIG. 3 is a rendering of an apparatus according to an example of the innovation.

Referring to FIG. 3, the apparatus 300 according to an example embodiment of the innovation may include a locking device 305 and a provision to conduct current for heating the wire. The apparatus may include a holding device 140 to hold a shape memory alloy (SMA) component 150 (e.g., a wire made from SMA).

Figure 4:
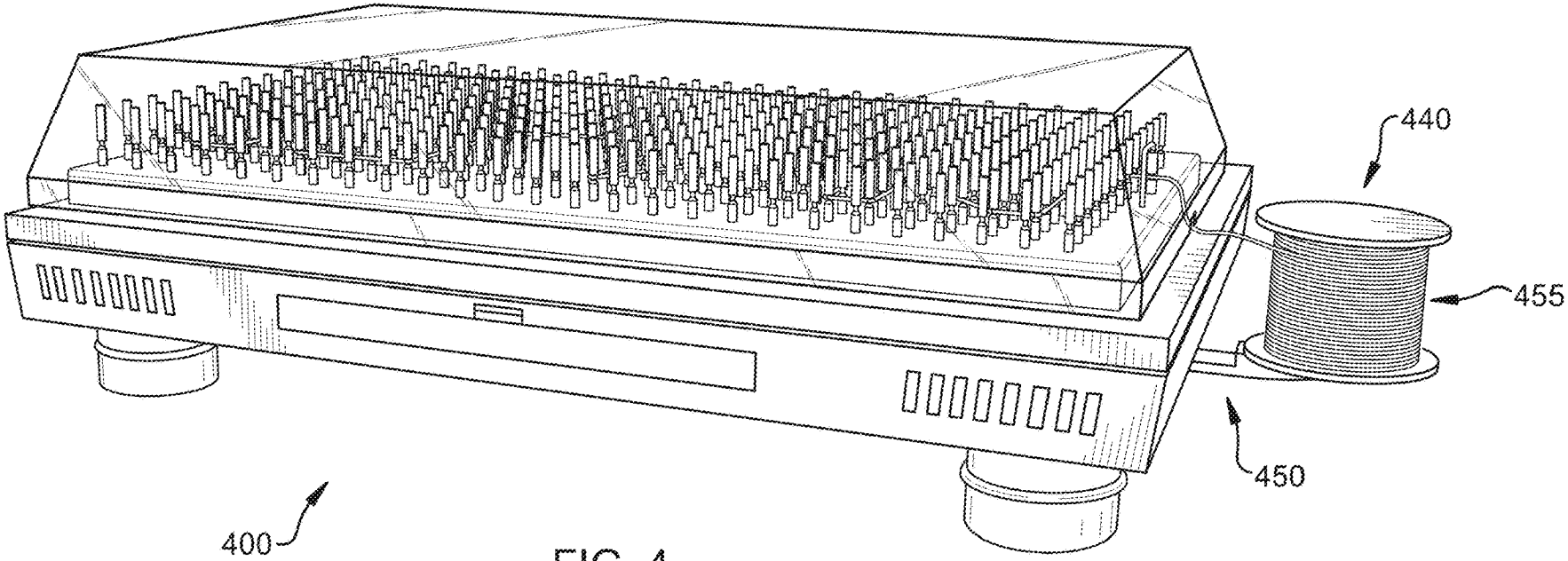
FIG. 4 is a rendering of an apparatus according to an example of the innovation.

Referring to FIG. 4, the apparatus 400 in one example embodiment may include a holding device 440 that is attached via an attaching member 450 to the apparatus 400. The holding device 440 may hold the SMA component (e.g., wire) 445 for use with the apparatus.

Figure 5A:
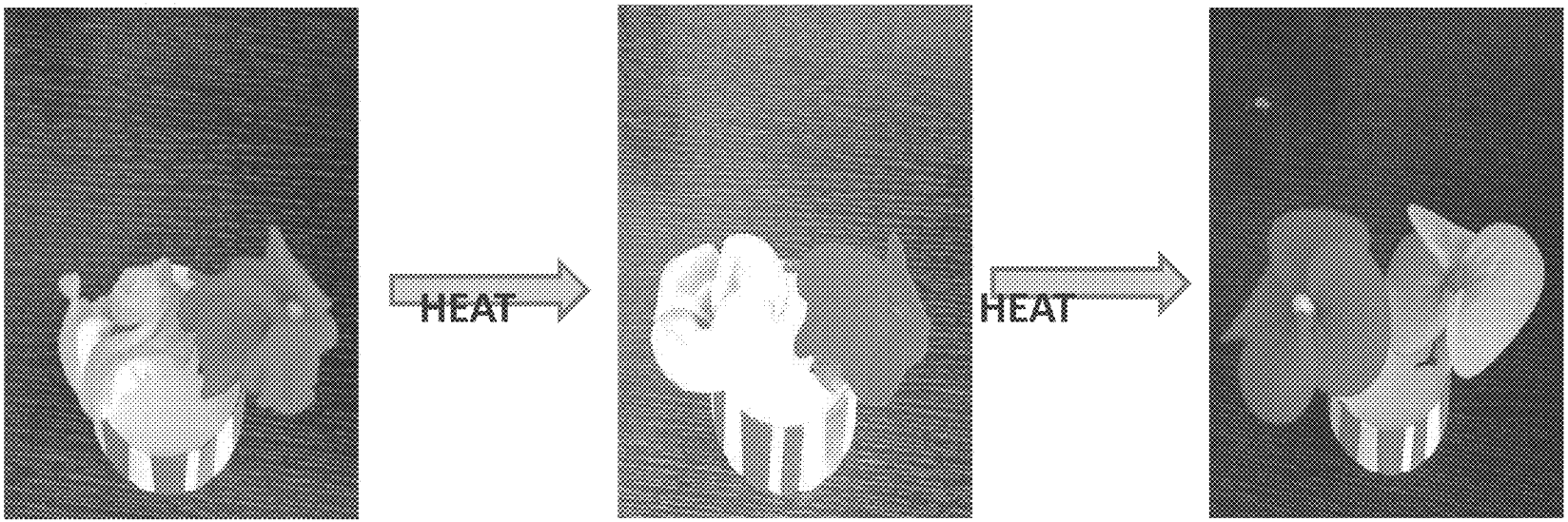
FIGS. 5A and 5B depict uses of an apparatus according to an example of the innovation.
Figure 5B:
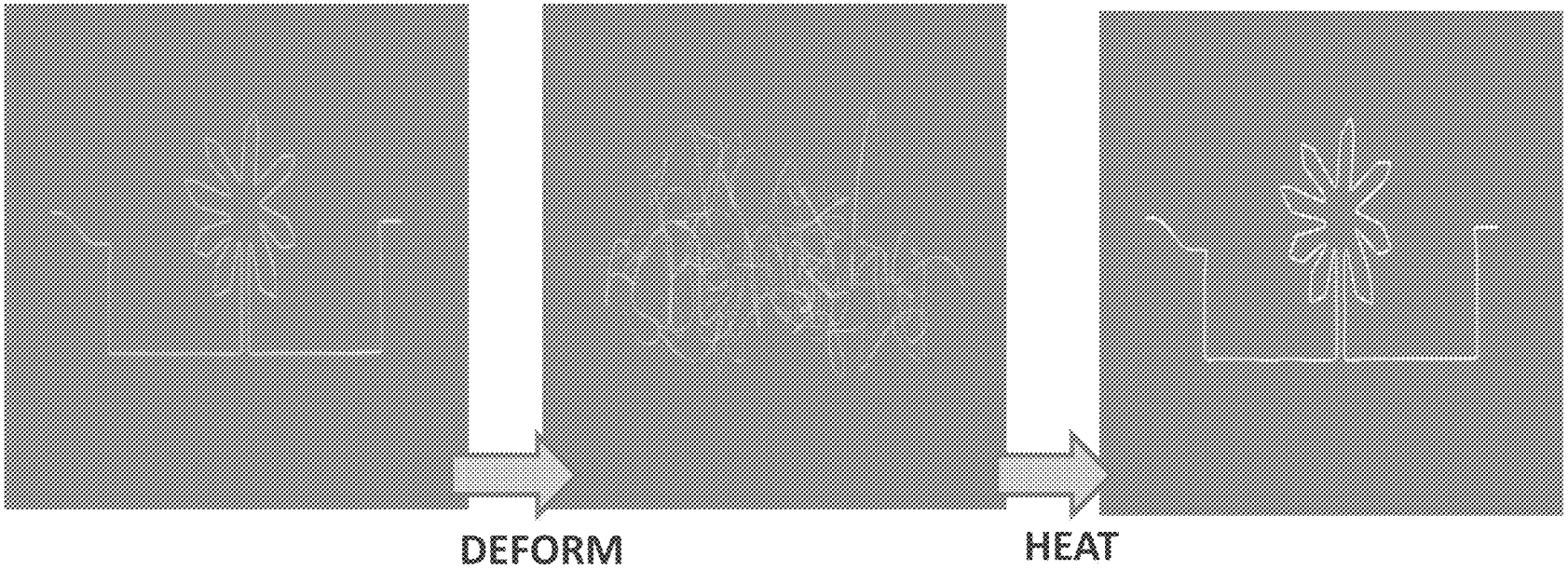

FIGS. 5A and 5B show possible products made using an apparatus or method according to an embodiment of the innovation. In FIG. 5A, shape memory alloys were used to create the shape of a flower. The flowers were deformed (first panel) and heat was applied to restore the original shape of the flower (last panel). In FIG. 5B, the SMA material was shaped (first panel), then deformed (second panel). After application of heat, the original shape was restored (last panel).

Figure 6:
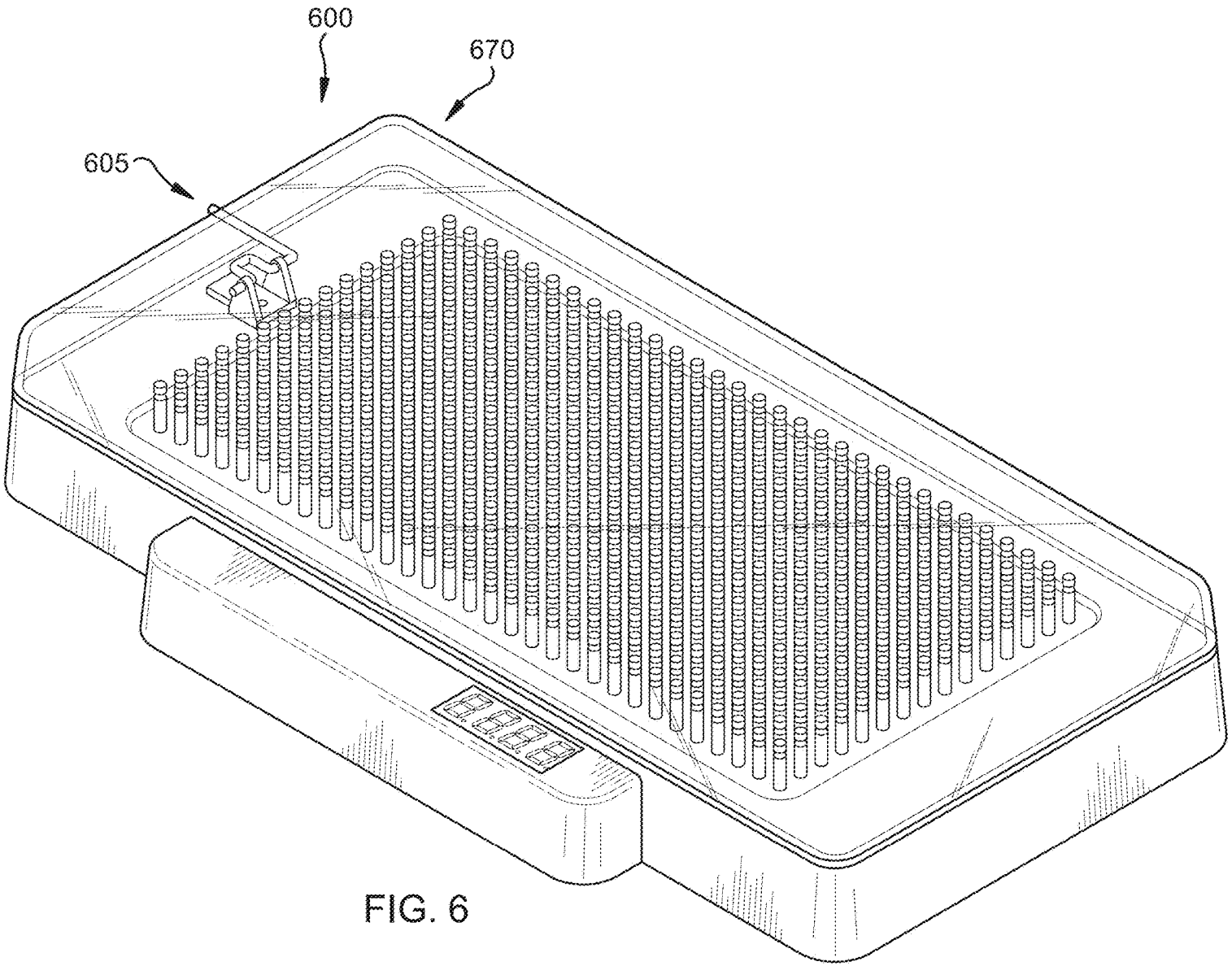
FIG. 6 is a rendering of an apparatus according to an example of the innovation.

Referring to FIG. 6, the apparatus 600 in an example embodiment may include a lid 670 and a locking device 605.

The apparatus can include swappable cylindrical mandrels to form helical springs for linear or torsional actuators. The mandrels along with the material used define the geometry and resulting stiffness that can be obtained after shape setting.

The apparatus or method can be used by educators in classrooms, workshops, or other event as a learning tool. The innovation may be used to advance science education and to inspire interest in science, technology, engineering, and mathematics. The innovation may also be used to make forms for gifts or toys that contain a secret message, special shapes, or any form that can reveal a specific message once heated (reset) back to the original formed shape.

The apparatus and method of the innovation can be used in classrooms, workshops, conferences, professional society meetings, museums, and other events to demonstrate the material science capabilities of the 21$^{st}$ century. The innovation provides adaptive, interactive, customized and individualized shape creation that can be built by the students/users. The apparatus and method of the innovation, provide an accessible means for demonstrating concepts of material science and the role of metallurgical engineering by forming shapes from, for example, a wire spool that can be deformed and recovered by simply applying heat.

In one embodiment names or characters can be deformed and then heated using hot water, heat guns, the sun, open flames or any other heating form to recover the shape (e.g., the name or character). Depending on the materials used, the shapes can also be recovered by the application of a magnetic field (to elucidate magnetism), or through the application of force (to elucidate mechanics).

The apparatus may be used in science kits. In one embodiment, the apparatus may be used in a kit that enables the formation of a wide variety shapes starting from the simplest form such as wire spool or ribbon. For example, a user can form secret-words that when heated tell a message, unique forms that shape-up when heated such as flowers, hearts, stars, etc., and many other symbols or characters. Other uses for the apparatus include toys and gifts.

In one embodiment, the apparatus may be used to make an actuator. In one embodiment, mandrels of different sizes can be added to make helical actuators, curved beams, or wire forms that transform the thermal energy into a mechanical work. This can be used for rapid prototyping of customized parts. The SMA components of the innovation enable any possible geometry needed for SMA actuators.

What has been described above includes examples of the innovation. It is, of course, not possible to describe every conceivable combination of components or methodologies for purposes of describing the subject innovation, but one of ordinary skill in the art may recognize that many further combinations and permutations of the innovation are possible. Accordingly, the innovation is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A method of forming a shape comprising:

shaping a shape memory alloy (SMA) component to a predetermined shape using an apparatus, the apparatus comprising:

a platform;

a plurality of structures that can accommodate and shape the (SMA) component;

a heating element for heating the SMA component, wherein the platform comprises at least one array of holes having a predetermined configuration to receive the plurality of structures; and control circuitry configured to control a temperature of the SMA component via the heating element;

forming the SMA component around the plurality of support structures located on the platform to form a predetermined shape of the SMA component;

heating, via the heating element, the predetermined shape of the SMA component while the SMA component is located on the platform and accommodated by the plurality of structures to shape set the SMA component;

distorting the predetermined shape of the SMA component after removing the device from the apparatus; and recovering the predetermined shape of the SMA component.

2. The method of claim 1, further comprising placing the plurality of structures into the at least one array of holes in the platform to create a predetermined configuration.

3. The method of claim 1, wherein the predetermined shape is a piece of jewelry.

4. The method of claim 1, wherein recovering the predetermined shape comprises heating the distorted shape.

5. The method of claim 1, wherein recovering the predetermined shape comprises exposing the distorted shape to a magnetic field.

6. The method of claim 1, wherein recovering the predetermined shape comprises changing the physical load exerted on the distorted shape.

* * * * *